US006986325B1

(12) United States Patent
Hsu

(10) Patent No.: US 6,986,325 B1
(45) Date of Patent: Jan. 17, 2006

(54) SCOOPING ASSEMBLY

(76) Inventor: Shih Hsu, 2868 Yojoa Pl., Hacienda Heights, CA (US) 91745

( * ) Notice: Subject to any disclaimer, the term of this patent is extended or adjusted under 35 U.S.C. 154(b) by 0 days.

(21) Appl. No.: 10/896,187

(22) Filed: Jul. 20, 2004

(51) Int. Cl.
*A01K 23/00* (2006.01)
*A01K 29/00* (2006.01)

(52) U.S. Cl. ..... 119/867; 119/161; 294/1.3

(58) Field of Classification Search ..... 119/867, 119/161, 792, 795; 294/1.3–1.5; 24/508–511
See application file for complete search history.

(56) References Cited

U.S. PATENT DOCUMENTS 3,703,158 A * 11/1972 Lemler ..... 294/1.3
3,738,697 A * 6/1973 Kahan ..... 294/1.4
3,841,684 A * 10/1974 Fleishman ..... 294/1.3
3,929,363 A * 12/1975 Kahan ..... 294/1.4
4,014,584 A * 3/1977 Bau ..... 294/1.4
4,200,319 A * 4/1980 Cooper ..... 294/1.4
4,247,139 A * 1/1981 Grieb ..... 294/1.4
5,564,763 A * 10/1996 Mercurio ..... 294/1.3
5,620,220 A * 4/1997 Khoshnood ..... 294/1.3

FOREIGN PATENT DOCUMENTS

JP 408116817 A * 5/1996

* cited by examiner

*Primary Examiner*—Son T. Nguyen
(74) *Attorney, Agent, or Firm*—Wang, Hartmann & Gibbs, P.C.; Erick P. Wolf; Larry E. Severin

(57) ABSTRACT

A scooping assembly includes at lease one container adapted to scoop up and dispose of pet droppings, and at least one clamping member adapted to removable engage the container. The scooping assembly further includes at least one triggering member operatively coupled to the clamping member and adapted to force the clamping member to release the container to allow the container to scoop up the pet droppings.

7 Claims, 6 Drawing Sheets

SCOOPING ASSEMBLY

FIELD OF THE INVENTION

This invention is generally related to scooping devices, and more particularly to a scooping assembly adapted to scoop up and dispose of waste material deposited by pet animals.

BACKGROUND OF THE INVENTION

In urban and/or suburban municipalities where the deposit of droppings from pet animals on sidewalks or other public places is forbidden by local regulations, many pet animal owners are faced with having to scoop after their pets on a daily basis. Violation of such regulations may bring fines, citations or the like.

Various scooping devices are available on the market forcing pet owners to expend significant resources on a continuous basis toward buying, maintaining, and/or repairing the same. As pet owners try to comply with such regulations, they frequently get soiled themselves in the process of cleaning up after their pets. Some pet owners use a simple dustpan and brush for this purpose. The droppings have to be transferred from the dustpan into a disposable bag or the like. Furthermore, the pet owner is obliged to clean the dustpan and brush after every use; bringing even more inconvenience to the owner.

Other pet owners attempt to train their pets to avoid discharging fluids and/or droppings while in public with questionable success. Some pet owners use old newspapers to scoop the ground after droppings have been deposited which leaves much to be desired in terms of sanitation. In all cases, the pet owner should be equipped with a variety of devices and/or supplies while walking his/her dog on the street or in the park. The very fact that the dog owner has to handle pet droppings in public may be rather embarrassing to some pet owners, not to mention the risk of infection, disease or the like.

SUMMARY OF THE INVENTION

A scooping assembly includes at least one container adapted to scoop up and disposes of pet droppings, at lease one clamping member adapted to removable engage the at least one container so that the at least one container opens and substantially encloses the pet droppings, and at least one triggering member operatively coupled to the at least one clamping member and adapted to force the at least one clamping member to release the at least one container and close the at least one container to allow the at least one container to substantially scoop up the pet droppings.

A scooping assembly may also include a substantially cylindrical container with two ends, the cylindrical container also having a slit spanning the length of the cylinder along the cylinder's longitudinal axis, and the ends configured with teeth-like openings that open with the slit, a scoop having a pair of clamping members, a pair of triggering members with top portions, one primary pivot pin, two secondary pivot pins, two primary springs, and two secondary springs, the clamping members being pivotally linked to each other through the primary pivot pin and tensioned with respect to each other through the two primary springs and axised about the primary pivot pin and having male ridges which are capable of interlocking with female ridges on the container to allow the scoop to open the container, the triggering members each being pivotally linked to a clamping member with a secondary pivot pin and tensioned with respect to the clamping member with a secondary spring and having substantially smooth male ends which are capable of pressing the female ridges and effectively releasing the container from the clamping members so that the container closes.

In practical use, a number of containers are securely attached along a pet's leash with a scoop attached to the handle of the leash by a string or similar device. The containers are substantially cylindrical and elastic in nature, each with long slits therein and each configured to open wide enough to accept conventional pet droppings. While on the leash, the slit within each container substantially conforms to the leash and the elastic nature of the container helps secure the container around the leash.

The scoop is configured with clamping members that are capable of conforming to the outer surface of the container. The clamping members also have ridges incorporated therein which mate with ridges located on the container to form a secure, but non-permanent, attachment. In addition to the clamping members, triggering members are used to release the containers from the scoop when needed. Both the clamping members and the triggering members are tensioned with springs. As such, when a user operates the scooping assembly, spring pressure is overcome to either open the scoop or to release the container from the scoop.

In order to pick up the pet droppings, the user first removes the scoop from the leash handle and then opens the scoop to attach the scoop to a container located on the leash. The combination of the scoop and the container form the scooping assembly. As mentioned above, the ridges on the clamping members of the scoop and the ridges on the container mate and form a secure connection. The user then opens the scoop and, because the scoop is securely attached to the container, the container opens accordingly. Once the container opens, it releases its grip on the leash. The container only needs to be opened wide enough to release its grip on the leash. With the scooping assembly, including the scoop and the container now in hand, the user bends down to remove the pet droppings. In order to do this, the clamping members are squeezed together to open the container wide enough to accept the pet droppings, but not so wide as to activate the triggering members and release the container from the scoop. The open container is then placed over the pet droppings. The scoop is then manipulated so that the scoop is opened wide enough to activate the triggering members. The triggering members operate to release the container from its secure attachment to the clamping members. Immediately thereafter, the container self closes around the pet droppings to pick up a substantial amount of the droppings. After the container closes, the user manipulates the scoop to pick the container up and then releases the container into a trash receptacle. In doing so, there is no need to form the secure connection mentioned above whereby the ridges of the clamping members securely engage with the ridges on the container because the container does not have to be opened again. This process may be repeated according to how many containers remain on the leash. In summary, this scooping assembly provides a quick, economical, and hygienic way to conveniently gather pet droppings so as not to violate any local pet waste ordinances.

These and other aspects of the invention will become apparent from a review of the accompanying drawings and the following detailed description of the invention.

BRIEF DESCRIPTION OF THE DRAWINGS

The invention is generally shown by way of reference to the accompanying drawings in which.

DETAILED DESCRIPTION OF THE INVENTION

Some embodiments are described in detail with reference to the related drawings of FIGS. 1 through 16. Additional embodiments, features and/or advantages will become apparent from the ensuing description or may be learned by practicing the invention.

In the figures, which are not drawn to scale, like numerals refer to like features throughout the description. The following description is not to be taken in a limiting sense, but is made merely for the purpose of describing the general principles of the invention.

Figure 1:
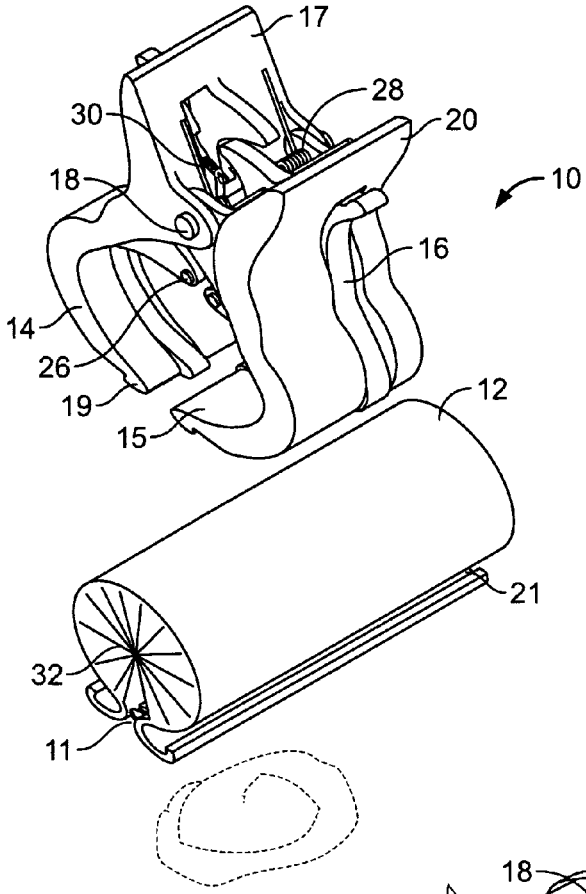
FIG. 1 is a perspective view of a scooping assembly wherein a scoop and a container are separated.

FIG. 1 illustrates one embodiment of a scooping assembly 10 including a container 12 adapted to scoop up and dispose of pet droppings, and a scoop 17 including two clamping members 14 adapted to removably engage the container and two triggering members 16 configured to release the container from the two clamping members of the scoop. The combination of the two clamping members and the two triggering members along with the components mentioned below form the scoop. In this figure, the scooping assembly, including the scoop and the container is shown before being put into use.

Figure 2:
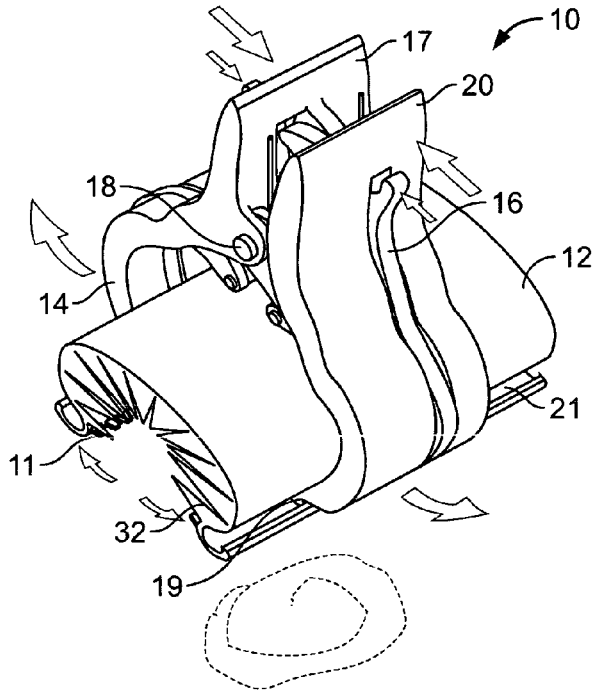
FIG. 2 is a perspective view of a scooping assembly wherein a scoop is opening a container.
Figure 4:
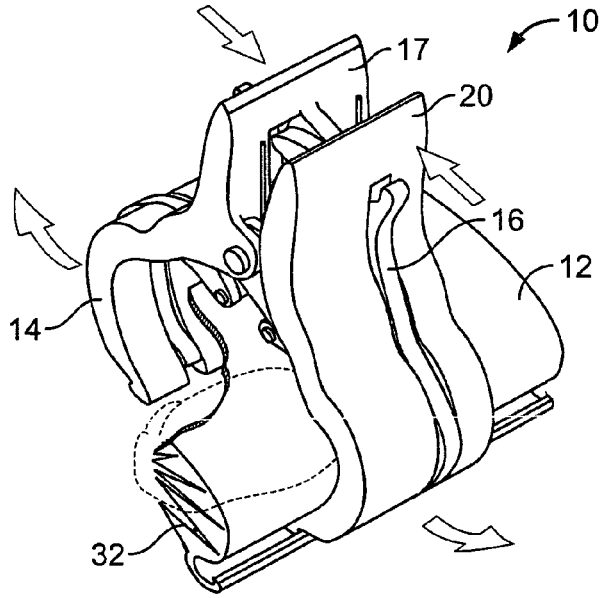
FIG. 4 is a partial cut-away, perspective, view of a scooping assembly wherein a scoop is partially opening a container.
Figure 5:
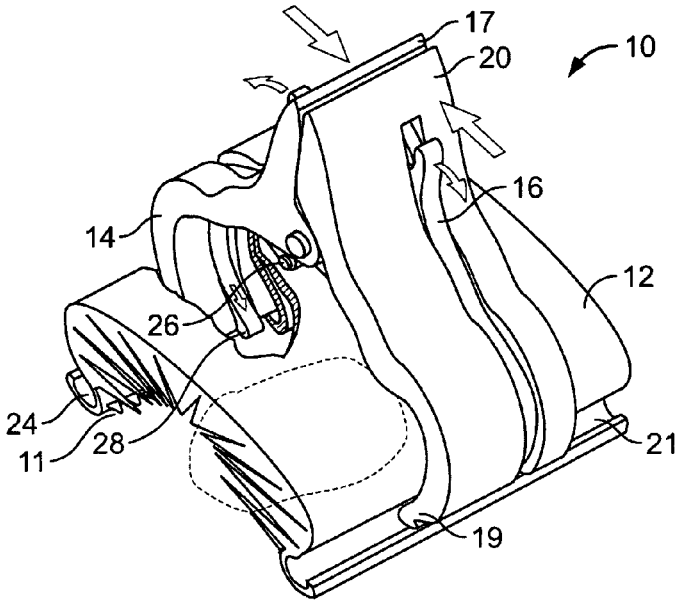
FIG. 5 is a partial cut-away, perspective, view of a scooping assembly wherein a scoop is completely opening a container.
Figure 6:
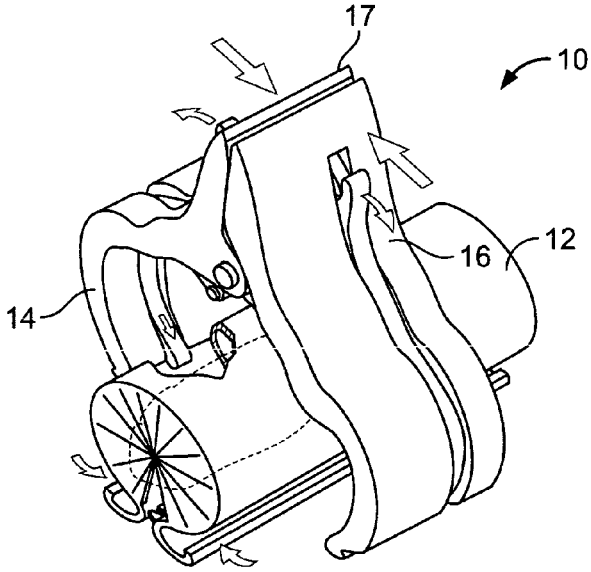
FIG. 6 is a partial cut-away, perspective view of a scooping assembly wherein a scoop is open and a container is closed and the two are not connected.
Figure 7:
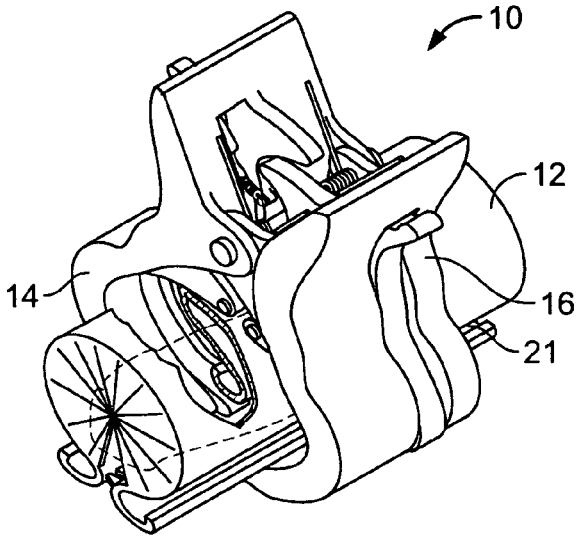
FIG. 7 is a partial cut-away, perspective view of a scooping assembly wherein a scoop is encircling a container.
Figure 8:
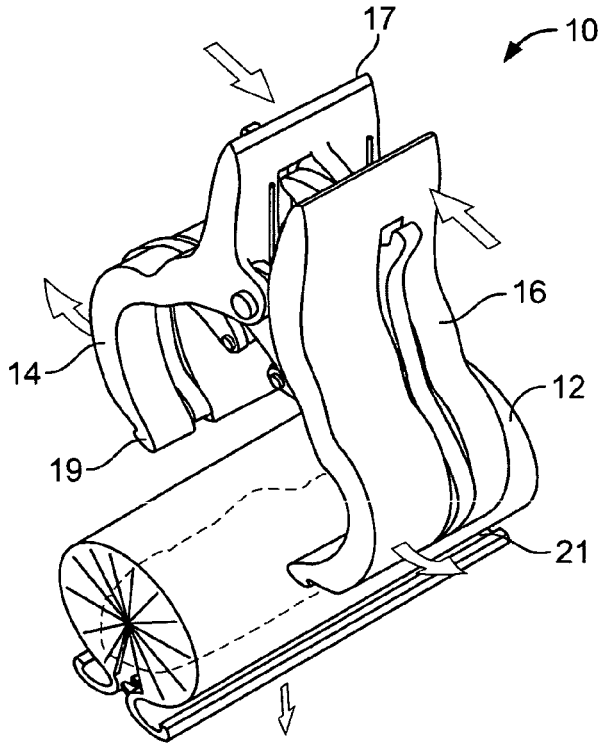
FIG. 8 is a perspective view of a scooping assembly wherein a scoop is open and a container is closed and the two are not connected.

Briefly, as shown in FIG. 2 the scoop 17 grasps the container 12 with the clamping members 14 to open the container to accept pet droppings. The scooping assembly 10 is then lowered over the pet droppings as shown in FIGS. 4 and 5. Thereafter, as shown in FIG. 6, the user opens the scoop further to release the container and thereafter the container self-closes to enclose a substantial portion of the pet droppings. Finally, the scoop is used to grasp the container again, this time without engaging the clamping members, to deposit the container in a trash receptacle as shown in FIGS. 7 through 8.

With respect to the scoop 17 of the scooping assembly 10 shown in FIG. 1, the scoop includes many parts; some of the main parts including the clamping members 14 and the triggering members 16. The clamping members are configured to removably attach the scoop to the container 12 and to open the container when needed. The triggering members are configured to be capable of separating the container from the clamping members (effectively from the scoop).

The clamping members 14 and the triggering members 16 of the scoop 17 are made out of a hard plastic material with sufficient rigidity to withstand the spring tension which will be applied to them. While a variety of other materials including various types of metals may be used for the clamping members and triggering members, making the members out of plastic keeps costs relatively low for the end user. Furthermore, the clamping members and triggering members may be made from conventional plastic molds.

The clamping members 14 are connected to each other through the use of a primary pivot pin 18. As shown in FIG. 1, one of the clamping members fits within the other and the primary pivot pin connects the two clamping members. As such, the clamping members are capable of pivoting together to open and close the scoop 17. The primary pivot pin is constructed from metal to withstand spring tension that is applied to it. In this embodiment, lubrication is not necessary between the plastic clamping members and the pivot pin. The primary pivot pin is also pinned on at least one end after being inserted into the scoop to securely retain the two clamping members together.

Two primary springs 28 are used to hold the clamping members 14 in tension with respect to each other and two secondary springs 30 are used to hold the triggering members 16 in tension with respect to the clamping members. In an alternative embodiment, the secondary springs are also positioned above the secondary pivot pins 26 or in any other convenient position which enables the triggering members to function properly. Also, in another embodiment, the primary springs are positioned in any other convenient position which enables the clamping members to function properly. The primary springs are positioned around the primary pivot pin 18 while the secondary springs are linked between the clamping members and the triggering members. In this embodiment, the primary springs and the secondary springs are of the commonly available, mass produced metal variety to be economical.

The secondary pivot pins 26 link the triggering members 16 to the clamping members 14. As shown in FIG. 1, the triggering members are located in the center of the clamping members. During application, once the scoop is opened wide enough, as shown in FIG. 5, contact between the triggering members and the opposing clamping members forces the triggering members to pivot with respect to the clamping members and contact the container to separate the clamping members from the container. Like the primary pivot pin 18, the secondary pivot pins are pinned on at least one side to securely retain the triggering members and also, like the primary pivot pin, the secondary pivot pins are dry and constructed from metal to be economical and to withstand tension that is applied from the secondary springs 30.

The container 12 may also be spring-loaded to retain its substantially cylindrical state and in one embodiment may be between one inch and twenty-four inches in length. While springs are not specifically shown in this embodiment, the container's material or the configuration of the container is such that the container substantially resembles a cylinder and has a resting position where an opening slit 11 runs along the longitudinal axis of the container. This type of configuration incorporates a cylindrical spring, which functions to keep the container in a closed position. As such, once the scoop 17 is separated from the container by the triggering members 16, the container closes and assumes a substantially cylindrical configuration with the slit in a substantially closed position.

Accordingly, the container 12 is made out of conventional materials such as metals, plastics, and rubbers and may be made out of single material to be relatively easy to produce and low in cost. Additionally, in one embodiment, the container is made out of a biodegradable material in order to be environmentally friendly as the container is substantially disposed of and not reused. It is also possible for the container to vary in size to be capable of scooping up a variety of animal droppings including horse droppings.

The scoop 17 and the container 12 may be made in a variety of different sizes and configurations in order to accommodate different needs. For instance, in other embodiments the container is sized to pick up a variety of different objects including indoor and outdoor trash, household items and to surround a series of cables or wires. When using the scooping assembly 10 with wires and cables, the container has ends which are malleable to allow the wires or cables to pass through the container when the container is closed. The container is fabricated from a hard plastic and is elastically hinged along its longitudinal axis to conform to the scoop when the scoop opens the container. This embodiment is useful where a set of wires coming from an entertainment system or computer system are to be bundled together to prevent clutter.

As depicted in FIG. 1, the container 12 is made out of thin elastic plastic. The container is substantially cylindrical in shape and includes a slit 11 running along the longitudinal axis which is capable of opening to accept pet droppings. Both sides of the cylindrical shaped container have a number of teeth 32 which allow the cylinder to open freely and substantially seal the container when it is closed (as in FIG. 1). The teeth are shown separated in FIG. 2 because the container is in its open position. Without any outward pressure on the container, the container rests in its closed and sealed position as shown in FIG. 1.

As mentioned above, the scoop 17 picks up and opens the container 12 to accept pet droppings. The scoop also picks up the loaded container such that the container is easily deposited in a trash receptacle. The scoop's clamping members 14, and thus the triggering members 16 pivot around a primary pivot pin 18. The triggering members are also capable of pivoting with respect to the clamping members around the secondary pivot pins 26. In the scoop's resting position, the clamping members are slightly separated at their lower end portions 15, as shown in FIG. 1. In order to keep the clamping members in such a configuration, two primary springs 28 are used. The primary springs, located along the primary pivot pin, ensure that there is tension between the two clamping members. Accordingly, when the scoop is squeezed, the primary springs wind up in tension and attempt to return the scoop to its resting state.

Similarly, the triggering members 16 are held in position by a set of two secondary springs 30 as shown in FIG. 1. On each triggering member, one spring holds the triggering member in tension with respect to the clamping member 14. As mentioned above, the triggering member is located with respect to the clamping member through the secondary pivot pins 26. In this configuration, there is little chance that the triggering members will move independently of the clamping members unless the user either opens the scoop wide enough to activate the triggering members or manually presses the triggering members outwardly.

Figure 14:
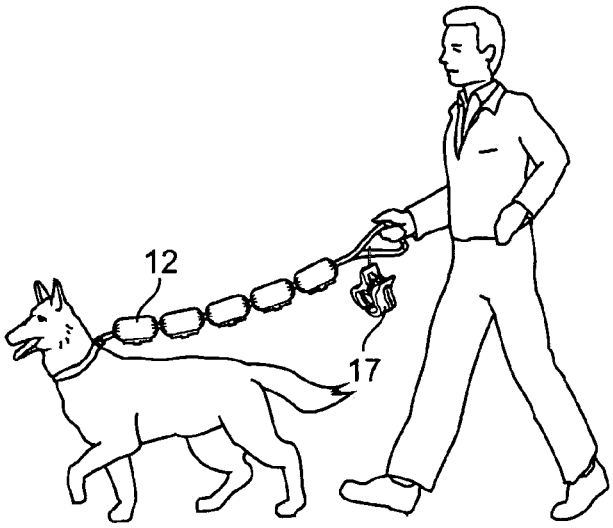
FIG. 14 is a perspective view of a scooping assembly wherein containers are attached to a dog leash and a scoop is attached to a dog leash handle.
Figure 15:
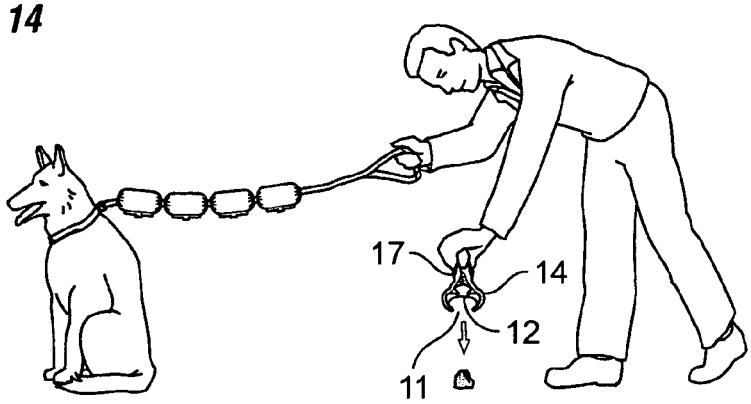
FIG. 15 is a perspective view of a scooping assembly wherein a container and a scoop are being used to pick up dog droppings.
Figure 16:
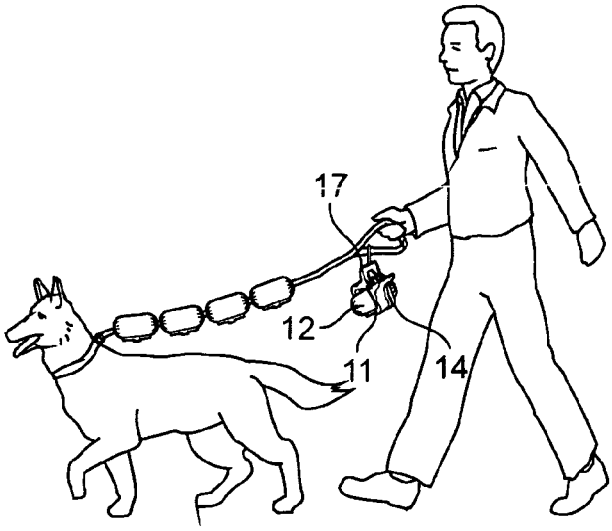
FIG. 16 is a perspective view of a scooping assembly wherein a scoop and a container are attached to a dog leash handle.

While walking one's pet such as their dog, the user may have a series of containers 12 arranged along a leash as shown in FIGS. 14 through 16. Because of the slit 11 running along the longitudinal axis of the container and the container's elasticity, the container is capable of conformably enclosing the leash so that the container is securely attached to the leash. In this configuration, many containers are placed upon the leash for multiple pick ups. When the user prepares to pick up pet droppings, the user removes the container from the leash by placing the scoop 17, located by a string to the leash handle, around the container.

More particularly, and as shown in the first embodiment illustrated in FIG. 1, the user first squeezes the upper portions 20 of the two clamping members 14 of the scoop 17 to open the scoop wide enough to fit around the container 12, but not so wide as to activate the triggering members 16. By squeezing the two clamping members, the scoop opens up so that it accepts the container. The scoop is then placed around the container and squeezing pressure is released on the two clamping members to allow the scoop to grasp the container as shown in FIG. 2.

When the scoop 17 grasps the container 12, the user aligns male ridge components 19 of the two clamping members 14 with female ridge components 21 of the container so that the male ridge components interlock with the female ridge components. This interlock between the clamping members and the container securely fastens the container within the scoop and effectively unites all components into the scooping assembly 10. As shown in FIGS. 1 through 8, the female ridge components of the container extend for the length of the container on each side and may vary in one embodiment from at least one inch to twenty-four inches in length. The female ridge components may also be configured as in FIGS. 9 through 12, where the female ridge components are centered along the length of the container 12 and relatively small in length. With relatively large containers, if the female ridge component is centered along the longitudinal axis of the container, the user may not accidentally try to open the container by one end and therefore not fully open the container.

Figure 3:
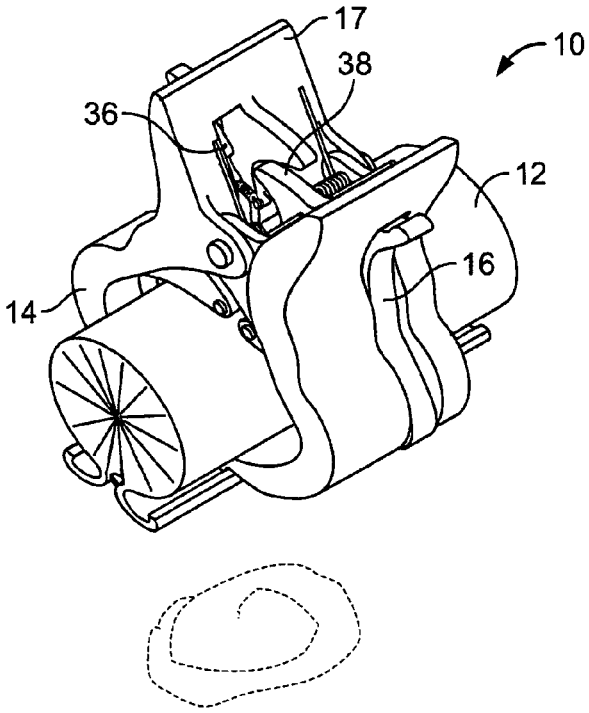
FIG. 3 is a perspective view of a scooping assembly wherein a scoop and a container are coupled together and the container is in a substantially closed position.

FIG. 3 shows the scooping assembly 10 in its resting state whereby the scoop 17 is securely attached to the container 12 with the female ridge components 21 of the container interlocked with the male ridge components 19 of the clamping members 14. In this figure, the triggering members 16 are not in practical use although they are capable of separating the container from the scoop.

As shown in FIG. 4, after grasping the container 12 with the scoop 17, the user squeezes the two clamping members 14 enough to free the container from a leash (not shown) but not so much as to activate the triggering members and separate the container from the scoop. By squeezing the two clamping members, the scoop opens along with the container, which is securely attached to the scoop through the male ridge components 19 and female ridge components 21. With the container essentially freed from its grasp around the leash, the entire scooping assembly 10 is then be removed from the leash.

At this point, the user can prepare to pick up the pet droppings. In order to open the container 12, to configure it to accept pet droppings, the user squeezes the clamping members 14 together again. This time, as compared to when removing the container from the leash, the user will likely squeeze the clamping members together so that the container will have its widest, pre-triggering activation, opening, stemming from its slit 11 and corresponding teeth 32 as shown in FIG. 2. This should be wide enough to accept the animal droppings desired to be picked up. In particular, the user squeezes the top portions 20 of the two clamping members together until the triggering members start to protrude from the clamping members or when additional tension is produced from the engagement of the triggering members' secondary springs. In some cases the secondary springs 30 have much more tension or tautness than the primary springs 28 so that it is very clear to the user when the triggering members are about to activate. Also, if the triggering members, particularly the tops, are configured to be enclosed within the clamping members, the triggering members will not protrude from the clamping members as shown in FIGS. 1–16.

The entire scooping assembly 10 is then placed on the ground so that the lower-most edges 24 of the container come into contact with the ground. This particular positioning of the scooping assembly permits the user to most effectively remove the pet droppings from the ground because as the lower-most edges of the container contract, they effectively "sweep" the pet droppings from the ground to pick up a substantial portion of the droppings.

At this point, the container 12 is completely expanded within the scoop 17, as shown in FIG. 5, its female ridge components 21 coupled with the male ridge 19 components of the scoop's clamping members 14. The user then presses the clamping members together, as shown in FIG. 5, so that opposing triggering members 16 contact opposing clamping members to rotate the triggering members about the secondary pivot pins 26 and separate the scoop from the container. More particularly, as mentioned above, the triggering members are pivotally attached to the clamping members through the secondary pivot pins to be capable of moving essentially axially independently of the clamping members. While the triggering members open and close with the clamping members, when they are moved about the secondary pivots pins, and against the tension created by the secondary springs 30, they move essentially independently of the clamping members. Such independent movement allows the triggering members to release the container from the scoop.

In more detail, when the scoop 17 is completely open, as shown in FIG. 5, and the pet droppings are about to be picked up, receiver 36, viewable in FIG. 3, of each triggering member 16 contacts protruder 38 of each opposing clamping member 14 so that the triggering members are effectively pushed outward so that they pivot upon the secondary pivot pins 26. As mentioned above, the receivers and the protruders are shown more clearly in FIG. 3. When this occurs, the male end components 28 of the triggering members apply pressure to the female ridge components 21 of the container 12 which effectively separates the female ridge components from the male ridge components 19 of the clamping members. When such separation occurs, the container closes up almost immediately as shown in FIG. 6, with a substantial portion of the pet droppings enclosed within. Because the male end components of the triggering members do not have ridges, there is no manner of holding the container open after the clamping members have been separated from the container.

After the container 12 has closed with a substantial portion of the pet droppings enclosed within as shown in FIG. 6, and the scoop 17 has released from the container, the container has to be picked up again so that it may be disposed. Accordingly, if the user has not released the tension on the clamping members 14, the scoop is placed close to the ground and tension is released on the clamping members so that the male ridge components 19 of the clamping members actually go under, and do not engage with female ridge components 21 of the container, as shown in FIG. 7. This manner of picking up the loaded container allows the container to be quickly released into a trashcan without the inconvenience of using the triggering members 16 to unlatch the clamping members and the container. As such, to dispose of the loaded container, the user holds the container above a trash receptacle and squeezes the clamping members so that the scoop opens up and the container freely drops as shown in FIG. 8.

Figure 9:
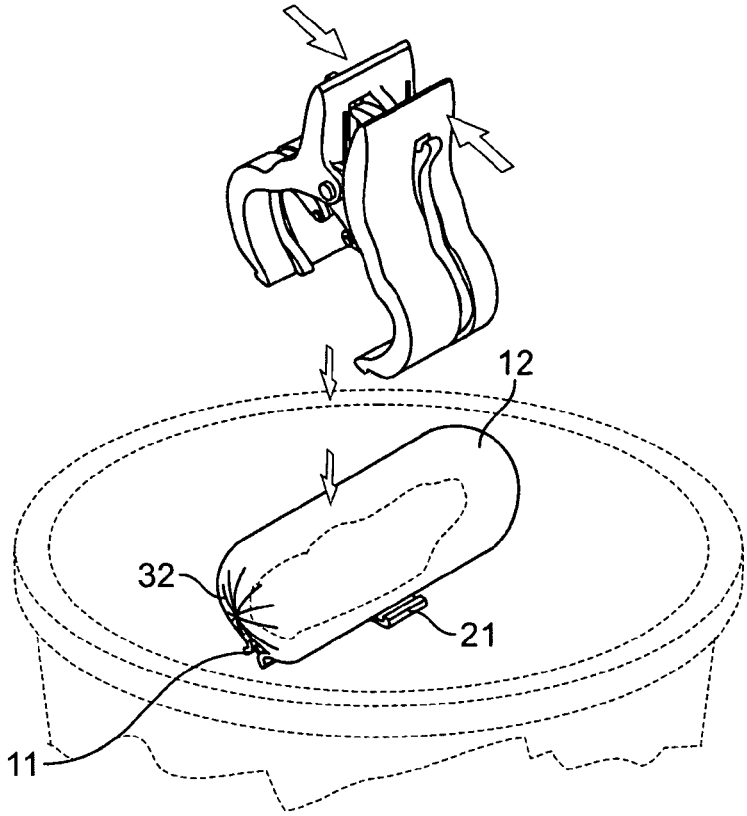
FIG. 9 is a perspective view of a scooping assembly wherein a scoop is open and a container is falling into a trash receptacle.
Figure 10:
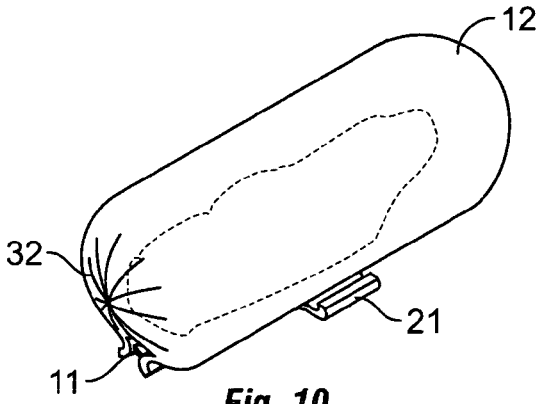
FIG. 10 is a perspective view of a substantially egg-shaped container with multiple teeth.
Figure 11:
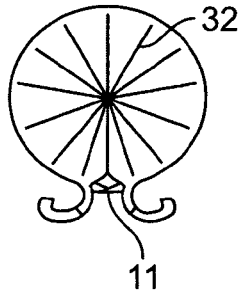
FIG. 11 is an end view of a substantially egg-shaped container with multiple teeth.
Figure 12:
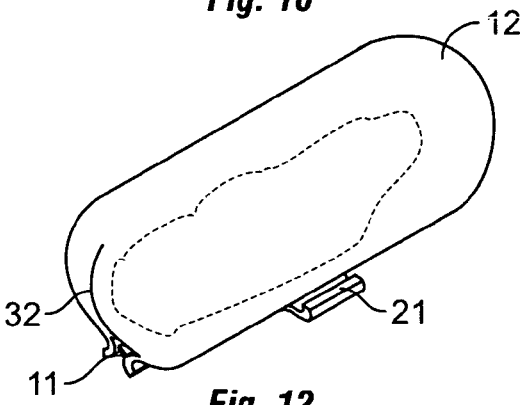
FIG. 12 is a perspective view of a substantially egg-shaped container with a slit.
Figure 13:
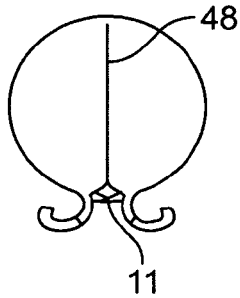
FIG. 13 is an end view of a substantially egg-shaped container with a slit.

FIGS. 9 through 13 illustrate different configurations for a container. As shown in FIGS. 9 through 11, the container 12 is substantially egg-shaped and incorporates relatively small female ridge components 21. The slit 11 spans substantially the length of the container along its longitudinal axis and a number of teeth 32 are formed at the ends of the container. Like the teeth 32 of the container 12 shown in FIGS. 1 through 8, the teeth 32 here open and close with the opening and closing of the container to accept pet droppings and to contain pet droppings, respectively. The container 12 with a small female ridge component 21 shown in FIGS. 12 and 13 is similar to the embodiment shown in FIGS. 9 through 11 except that there are no teeth, but a second slit 48 on both ends that opens with a long slit 11 running the approximate length of the container along the container's longitudinal axis.

FIGS. 14 through 16 illustrate an embodiment in application. As shown in FIG. 14, a user is walking his dog with a series of five containers 12 attached around a leash. The scoop 17 is attached by a string to the leash handle. In FIG. 15, the user is bending down to pick up dog droppings. The scoop is opened along with the container to allow the scooping assembly to pick up the dog droppings. In FIG. 16, the user has placed the container and scoop on the leash and may now continue on his walk and drop the container off in a trash receptacle at his convenience.

While several embodiments have been described in detail, it should be appreciated that various modifications and/or variations may be made without departing from the scope or spirit of the invention. In this regard it is important to note that practicing the invention is not limited to the applications described herein above. Many other applications and/or alterations may be utilized provided that such other applications and/or alterations do not depart from the intended purpose of the invention.

Also, features illustrated or described as part of one embodiment may be used in another embodiment to provide yet another embodiment such that the features are not limited to the embodiments described herein above. Thus, it is intended that the invention cover all such embodiments and variations as long as such embodiments and variations come within the scooping assembly of the appended claims and its equivalents.

What is claimed is:

1. A scooping assembly, comprising:

a substantially cylindrical container with two ends, the cylindrical container also having a slit spanning the length of the cylinder along the cylinder's longitudinal axis, and the ends configured with teeth-like openings that open with the slit;

a scoop having a pair of clamping members, a pair of triggering members with top portions, one primary pivot pin, two secondary pivot pins, two primary springs, and two secondary springs;

the clamping members being pivotally linked to each other through the primary pivot pin and tensioned with respect to each other through the two primary springs and axised about the primary pivot pin and having male ridges which are capable of interlocking with female ridges on the container to allow the scoop to open the container;

the triggering members each being pivotally linked to a clamping member with a secondary pivot pin and tensioned with respect to the clamping member with a secondary spring and having substantially smooth male ends which are capable of pressing the female ridges and effectively releasing the container from the clamping members so that the container closes.

2. The scooping assembly of claim 1, wherein the cylindrical container is between one inch and twenty-four inches in length.

3. The scooping assembly of claim 1, wherein the cylindrical container is made from a hard plastic and elastically hinged along its longitudinal axis.

4. The scooping assembly of claim 1, wherein the cylindrical container has female ridge components between one inch and twenty-four inches in length along the longitudinal axis of the container.

5. The scooping assembly of claim 1, wherein the teeth-like openings of the cylindrical container are malleable to be capable of conforming to a series of objects extending through the ends of the container.

6. The scooping assembly of claim 1, wherein the secondary springs are tauter than the primary springs to signal the user when the triggering members are about to be activated.

7. The scooping assembly of claim 1, wherein the tops of the triggering members are located within the clamping members to be within the clamping members when the scoop is completely opened.

* * * * *